US009315016B2

(12) United States Patent
Watanabe

(10) Patent No.: US 9,315,016 B2
(45) Date of Patent: Apr. 19, 2016

(54) INKJET HEAD AND METHOD OF MANUFACTURING INKJET HEAD

(71) Applicant: Hideo Watanabe, Tokyo (JP)

(72) Inventor: Hideo Watanabe, Tokyo (JP)

(73) Assignee: KONICA MINOLTA HOLDINGS, INC., Tokyo (JP)

( * ) Notice: Subject to any disclaimer, the term of this patent is extended or adjusted under 35 U.S.C. 154(b) by 0 days.

(21) Appl. No.: 14/055,103

(22) Filed: Oct. 16, 2013

(65) Prior Publication Data

US 2014/0043399 A1 Feb. 13, 2014

Related U.S. Application Data

(62) Division of application No. 11/465,169, filed on Aug. 17, 2006, now Pat. No. 8,584,358.

(30) Foreign Application Priority Data

Aug. 23, 2005 (JP) ..... 2005-241739
Jun. 14, 2006 (JP) ..... 2006-165378

(51) Int. Cl.

| | |
|---|---|
| ***B41J 2/015*** | (2006.01) |
| ***B41J 2/045*** | (2006.01) |
| ***B41J 2/14*** | (2006.01) |
| ***B41J 2/16*** | (2006.01) |

(52) U.S. Cl.

CPC ..... *B41J 2/04501* (2013.01); *B41J 2/14209* (2013.01); *B41J 2/1609* (2013.01); *B41J 2/1623* (2013.01); *B41J 2/1632* (2013.01); *B41J 2/1634* (2013.01); *B41J 2/1642* (2013.01); *B41J 2/1643* (2013.01); *B41J 2/1646* (2013.01); *B41J 2002/14362* (2013.01); *B41J 2002/14491* (2013.01); *Y10T 29/42* (2015.01); *Y10T 29/49128* (2015.01); *Y10T 29/49147* (2015.01); *Y10T 29/49401* (2015.01)

(58) Field of Classification Search

None

See application file for complete search history.

(56) References Cited

U.S. PATENT DOCUMENTS

| | | | | |
|---|---|---|---|---|
| 5,365,643 | A | 11/1994 | Fujimoto | |
| 5,432,540 | A | 7/1995 | Hiraishi | |
| 5,625,393 | A * | 4/1997 | Asai | 347/69 |
| 6,390,609 | B1 | 5/2002 | Shigemura et al. | |
| 2004/0130602 | A1 * | 7/2004 | Watanabe | 347/68 |

* cited by examiner

*Primary Examiner* — Erica Lin

(74) *Attorney, Agent, or Firm* — Lucas & Mercanti, LLP

(57) ABSTRACT

An inkjet head has a head chip. The head chip has driving walls of piezoelectric material, which deform by applying voltage, to jet ink. Channels are arranged alternatively, alongside the driving walls and contain ink. Each channel has an outlet and an inlet port at a front and rear surface of the head chip. Driving electrodes, formed on surfaces of the driving walls, apply voltage to the driving walls. Connection electrodes, formed on the rear surface of the head chip, electrically connect to the driving electrodes. A wiring substrate, having wiring electrodes apply voltage to the driving electrode through the connection electrode. The wiring substrate is bonded to the rear surface of the head chip to protrude from the head chip in a direction perpendicular to the direction of the channels so that all the channels are exposed at the rear surface of the head chip.

9 Claims, 10 Drawing Sheets

INKJET HEAD AND METHOD OF MANUFACTURING INKJET HEAD

CROSS REFERENCE TO RELATED APPLICATIONS

This is a Divisional application of U.S. patent application Ser. No. 11/465,169 filed on Aug. 17, 2006, which, in turn, claims the priority of Japanese Patent Application Nos. 2005-241739 filed on Aug. 23, 2005 and 2006-163378 filed on Jun. 14, 2006, the entire contents of all three are hereby incorporated by reference herein.

BACKGROUND OF THE INVENTION

The present invention relates to an inkjet head and to a method of manufacturing the inkjet head, and in particular to an inkjet head wherein speed distribution of each channel is easily uniformed even incase of a harmonica type head chip, and to a method of manufacturing the inkjet head thereof.

In recent years, in inkjet heads to record images by jetting ink from a nozzle, multi channel has been developed to improve recording speed and image quality. In such multi channel inkjet head, uniformity of speed distribution of ink jetted from the nozzles is an important factor. Since jetting speed of ink from the nozzle is related to a volume of ink particle and a diameter of ink particle, the channel characteristics including above factors have to be uniformized.

In inkjet head, there are a type wherein the inkjet head moves relative to a recording sheet and the other type wherein recording sheet moves relative to the stable inkjet head. In both types, nonuniform channel characteristics cause dispersion of landing accuracy of ink due to nonuniform speed distribution, thus deteriorates the quality of obtained image. Inkjet head in practice usually has some speed distribution because of dispersion of performance of PZT as a material and of non-uniformity of production process.

To make speed distribution uniform, there is a method to optimize driving voltage for each channel, however since a driving circuit has to be provided for each channel, cost increase is a problem. Usually, because a single power source applies voltage to each channel, each driving voltage becomes the same and it is unavoidable that speed of ink jetted from each nozzle varies.

Conventionally, technologies to make the speed distribution uniform have been known. They are a technology to configure the head using piezoelectric oscillator wherein a part of electrode is removed to obtain desired electro-mechanical characteristics (Patent document 1), a technology to trim an electrode surface of piezoelectric element so that characteristic variation among each nozzle is minimized by checking jetting characteristics of ink through a characteristic measuring device after assembling the head (Patent Document 2), and a technology to adjust ink speed by providing a cutout section in a common electrode of piezoelectric surface of piezoelectric element where distortion due to unimolf mode occurs when variations are measured among each nozzle through measurement of ink speed from each nozzle (patent Document 3). However, it is preferred that speed distribution is obtained by actual driving and the electrode is adjusted by trimming based on the result of speed distribution.

Meanwhile, among inkjet heads, there is known an shearing mode inkjet head in which channels are formed by grinding, driving electrodes are formed on the driving walls separating each channel, and dogleg shear distortion is caused by applying voltage to the driving electrode so as to jet ink in the channel from the nozzle.

Among them, an inkjet head (for example Patent document 4 and 5) wherein an actuator to jet ink is configured by so-called harmonica type head chip in which the driving wall composed of piezoelectric element and the channel are arranged alongside alternatively, and an outlet port and an inlet port of the channel are provided each on a front and rear surfaces, can be produced from one substrate in a large number at one time with extremely high productivity. Also, due to its straight shape through out the inlet port to the outlet port of the channel, it has merits of good air purging ability, high electric power efficiency, low heat generation and high speed response. In the inkjet head having such harmonica type head chip, ability of recording higher quality image is also desired by making speed distribution among each nozzle uniform.

In such harmonica type head chip, connection of a wiring to apply driving voltage to the driving electrode is difficult. Then, usually, the electrode to be connected with each driving electrode is extended to outside the head chip and a wiring is connected outside the head chip.

For example, in the technology mentioned in Patent Document 4, the head chip is placed between two substrata and the electrode is formed to be connected with each driving electrode electrically on the substrata so that driving voltage from the driving circuit is applied to each electrode through the substrata. In this case, an ink supply channel is termed by arranging a wall section across two substrata on rear surface (inlet port side of the channel) of the head chip.

Also, in a technology mentioned in Patent Document 5, the head chip is placed between two substrata, an ink supply chamber is formed by providing a wall section across two substrata on the rear surface (inlet port side of the channel) of the head chip, the wall section further protrudes backward from the substrata, and the electrode to be electrically connected with each driving electrode is formed on the substrata so that driving voltage is applied from the driving circuit to each driving electrode by using the substrate and the protruding section.

Patent document 1: Tokkaishou 57-181874
Patent document 2: Tokkaishou 61-118261
Patent document 3: Tokkai 2000-127384
Patent document 4: Tokkai 2004-209796
Patent document 5: Tokkai 2004-358751

In case of inkjet head having harmonica type chip head, as disclosed in Patent document 4 and 5, the driving electrode is completely closed in the channel. Also, on the rear surface side of the head chip, there is located a substrate where the electrode to apply driving voltage to each driving electrode is extended. Thus, it is difficult to adjust the driving electrode by trimming after manufacturing the inkjet head because the substrate obstructs adjustment.

If flexible material such as FPC (flexile printed circuit) is use for each substrate, it is possible to bend the substrate in a large angle to trim each driving electrode. However, bending status has to be kept during trimming work and if is not preferable since there are risks of folding down, separation and breakage of the substrate.

SUMMARY OF THE INVENTION

Thus, an object of the present invention is to provide an inkjet head wherein the channel characteristics can be easily made uniform by adjusting the shear deformation function of the driving wall of a harmonica type head chip.

Another object of the present invention is to provide a method of manufacturing an inkjet head provided with a harmonica type head chip, wherein channel characteristics are easily made uniform by adjusting the shear deformation function of the driving wall subsequent to formation of a head chip.

Other objects of the present invention will become apparent from the following description:

The aforementioned objects can be achieved by the followings:

(1) An inkjet head containing;

a driving wall made of a piezoelectric element and a channel arranged alternately;

an outlet and inlet port of the channel arranged on the front and rear; and a head chip with a driving electrode formed on the aforementioned driving wall;

wherein voltage is applied to the aforementioned driving electrode to cause shear-deformation of the aforementioned driving wall, so that ink in the aforementioned channel is jetted from the nozzle;

the aforementioned inkjet head further characterised in that:

a connection electrode electrically connected with the aforementioned driving electrode is formed on the rear surface of the head chip;

a wiring substrate provided with a wired electrode for applying voltage from the driving circuit to the aforementioned driving electrode through this connection electrode is connected so as to extend from the head chip in the direction perpendicular to the direction of the channel array; and the aforementioned wiring substrate has an opening that opens in such a way that all the channels are exposed to the area corresponding to the channel array of the head chip.

(2) An inkjet head containing:

a driving wall made of a piezoelectric element and a channel being arranged alternately;

the outlet and inlet port of the channel being arranged on the front and rear surfaces;

a head chip with a driving electrode formed on the aforementioned driving wall;

wherein voltage is applied to the aforementioned driving electrode to cause shear deformation of the aforementioned delving wall, so that ink in the aforementioned channel is jetted from the nozzle;

the aforementioned inkjet head further characterized in that:

a connection electrode electrically connected with the aforementioned driving electrode is formed on the rear surface of the aforementioned head chip;

one end of the wiring substrate provided with a wired electrode for applying voltage from the driving circuit to the aforementioned driving electrode through this connection electrode is connected to the connection electrode connection area in such a way that all the channels of the head chip are exposed; and the other end of the wiring substrate extends from the head chip in a direction perpendicular to the direction of the channel array.

(3) An inkjet head described in (1) or (2) wherein the extending end of the aforementioned wiring substrate is a wiring connection section for applying voltage from the driving circuit, and an FPC (flexible printed circuit board) is connected to supply voltage from the driving circuit to the wiring connection.

(4) An inkjet head described in (1) or (2) wherein the aforementioned wiring substrate is made of a FPC.

(5) A method of manufacturing an inkjet head containing:

a driving wall made of a piezoelectric element and a channel being arranged alternately;

the outlet and inlet port of the channel being arranged on the front and rear surfaces;

a head chip with a driving electrode formed on the aforementioned driving wall;

wherein voltage is applied to the aforementioned driving electrode to cause shear deformation of the aforementioned driving wall, so that ink in the aforementioned channel is jetted from the nozzle;

the aforementioned inkjet head manufacturing method further characterized in that after the aforementioned head chip has been produced, the shear deformation function of the aforementioned driving wall is adjusted from the rear surface of the head chip.

(6) A method of manufacturing an inkjet head described in (5), containing the steps of:

measuring the ink particle velocity distribution by supplying ink to each channel after production of the aforementioned head chip, applying voltage to the aforementioned driving electrode, emitting ink from each nozzle and measuring the velocity of the ink particle; and adjusting the shear deformation function of the aforementioned driving wall from the rear surface of the aforementioned head chip to ensure that the velocity distribution will be uniformed, based on the velocity distribution having been measured.

(7) A method of manufacturing an inkjet head described in (5), containing the steps of:

measuring the ink particle volume distribution by supplying ink to each channel after production of the aforementioned head chip, applying voltage to the aforementioned driving electrode, emitting ink from each nozzle and measuring the volume of the ink particle; and adjusting the shear deformation function of the aforementioned driving wall from the rear surface of the aforementioned head chip to ensure that the volume distribution will be uniformed, based on the volume distribution having been measured.

(8) A method of manufacturing an inkjet head described in (5), containing the steps of:

measuring the ink particle diameter distribution by supplying ink to each channel after production of the aforementioned head chip, applying voltage to the aforementioned driving electrode, emitting ink from each nozzle and measuring the diameter of the ink particle; and adjusting the shear deformation function of the aforementioned driving wall from the rear surface of the aforementioned head chip to ensure that the diameter distribution will be uniformed, based on the diameter distribution having been measured, (9) method of manufacturing an inkjet head described in (5), containing the steps of:

closing all channels from the front surface of the head chip after production of the aforementioned head chip;

measuring channel characteristics by filling each channel with liquid, applying voltage to the aforementioned driving electrode, causing the aforementioned driving wall to be shear deformed, and measuring the behavior of the aforementioned liquid using a laser Doppler velocimeter; and adjusting the shear deformation function of the aforementioned driving wall from the rear surface of the aforementioned head chip, based on the channel characteristics having been measured, to ensure that the channel characteristics will be uniform.

(10) A method of manufacturing an inkjet head described in (5), containing the steps of:

measuring the capacity distribution of the aforementioned arriving wall of each channel after production of the aforementioned head chip; and adjusting the shear deformation function of the aforementioned driving wall from the rear surface of the aforementioned need chip, based on the capacity distribution having been measured, to ensure that the capacity distribution will be uniform.

(11) A method of manufacturing an inkjet head described in any one of (1) through (10) containing the steps of:

forming a connection electrode for electrical connection with the aforementioned driving electrode on the rear, surface of the aforementioned head chip; and connecting the wiring substrate large enough to extend from the head chip in the direction perpendicular to the channel array in such a way that the aforementioned connection electrode and one end of the aforementioned wired electrode are electrically connected, and all the channels of the aforementioned head chip are exposed from the aforementioned opening, wherein the aforementioned wiring substrate is provided with a wired electrode corresponding to the aforementioned connection electrode, and is provided with an opening arranged in the area corresponding to the channel array of the aforementioned head chip.

(12) A method of manufacturing an inkjet head described in any one of (5) through (10), containing the steps of:

forming a connection, electrode for electrical connection with the aforementioned driving electrode on the rear surface of the aforementioned head chip; and connecting one end of the wiring substrate to the area wherein the connection electrode is formed on the rear surface of the head chip, in such a way that the aforementioned connection electrode and one end of the aforementioned wired electrode are electrically connected, and all the channels of the aforementioned head chip are exposed, wherein the aforementioned wiring substrate is provided with a wired electrode corresponding to the aforementioned connection electrode.

(13) A method of manufacturing an inkjet head, described in any one of (5) through (12) wherein the shear deformation function of the aforementioned driving wall is adjusted by removing at least a part of one of the aforementioned driving electrode and driving wall by laser.

The invention of Claim 14 is a method of manufacturing an inkjet head described in any one of (5) through (12), wherein the shear deformation function of the aforementioned driving wall is adjusted by removing a part of at least one of the aforementioned driving electrode and driving wall.

(15) A method of manufacturing an inkjet head described in any one of (5) through (12), wherein the shear deformation function of the aforementioned driving wall is adjusted by heating a part of the aforementioned driving wall by laser.

The structure of (1) provides an inkjet head that allows easy uniform processing of channel characteristics through the opening, because the rear portion of the head chip can be kept open to provide a large space, even if a wire for voltage application is connected to each driving electrode of the harmonica type head chip.

The structure of (2) provides an inkjet head that, allows easy uniform processing of channel characteristics, because the rear portion of the head chip can be kept open to provide a large space, even if a wire for voltage application is connected to each driving electrode of the harmonica type head chip.

The structure (3) provides an inkjet head that further allows easy connection of the FPC, because the FPC for supplying voltage from the driving circuit to the driving electrode can be connected using the protruding end of the wiring substrate.

The structure of (4) provides an inkjet head wherein wiring connection for connection between the head chip and wiring substrate and connection for application of driving voltage to each driving electrode can be performed simultaneously, with the result that the number of man hours can be reduced.

The method of manufacturing an inkjet head in (5), wherein channel characteristics can be made uniform by adjusting the shear deformation function of the driving wall from the rear surface of the harmonica type head chip having been produced, whereby high quality image recording is ensured.

The method of manufacturing an inkjet head in (6), wherein channel characteristics can be made uniform by making the ink velocity distribution of each channel uniform, based on the result of measuring the actual ink jetting velocity, whereby high quality image recording is ensured.

The method of manufacturing an inkjet head in (7), wherein channel characteristics can be made uniform by making the ink volume distribution of each channel uniform, based on the result of measuring the ink particle volume by actual ink jetting, whereby high quality image recording is ensured.

The method of manufacturing an inkjet head (8), wherein channel characteristics can be made uniform by making the ink particle diameter distribution of each channel uniform, based on the result of measuring the ink particle diameter by actual ink jetting, whereby high quality image recording is ensured.

The method of manufacturing an inkjet head of (9), wherein channel characteristics can be made uniform based on the result of measuring the channel characteristics using a laser Doppler velocimeter, whereby high quality image recording is ensured.

The method of manufacturing an inkjet head (10), wherein channel characteristics can be made uniform based on the result of measuring the capacity distribution of the driving wall of each channel, whereby high quality image recording is ensured.

The structure of (11) further permits easy adjustment of the shear deformation function of the driving wall through the opening from the rear surface of the head chip, even when a wiring substrate for wire connection is provided on the rear surface of the head chip.

The structure of (12) further permits exposition of all channels and easy adjustment of the shear deformation function of the driving wall from the rear surface of the head chip, even when a wiring substrate for wire connection is provided on the rear surface of the head chip.

The structure of (13) further permits easy adjustment of the shear deformation function of the driving wall by laser.

The structure of (14) further permits easy mechanical adjustment of the shear deformation function of the driving The structure of (15) further permits easy adjustment of the shear deformation function of the driving wall by laser heating.

DETAILED DESCRIPTION OF THE PREFERRED EMBODIMENT

Figure 1:
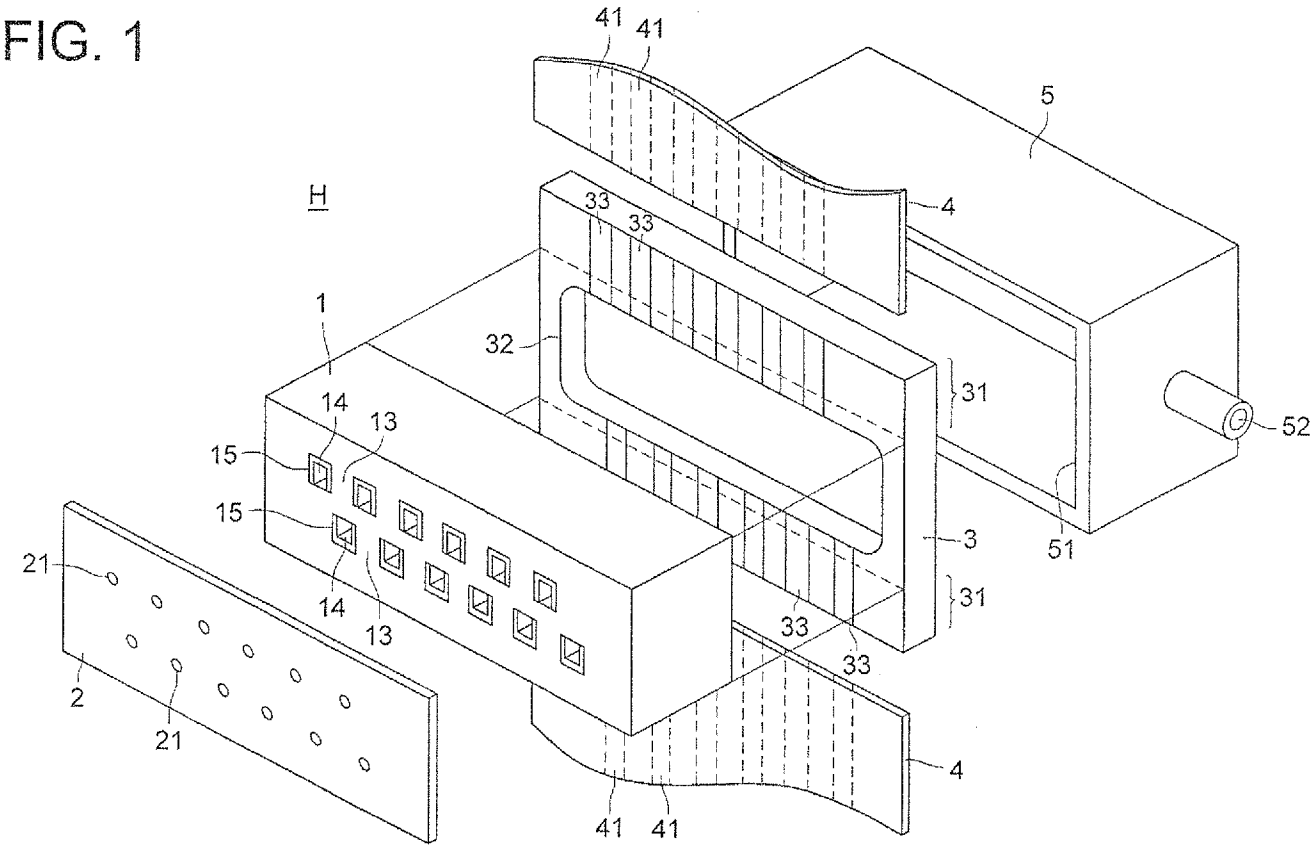
FIG. 1 is an exposed perspective view showing an example of the inkjet head of the present invention.
Figure 2:
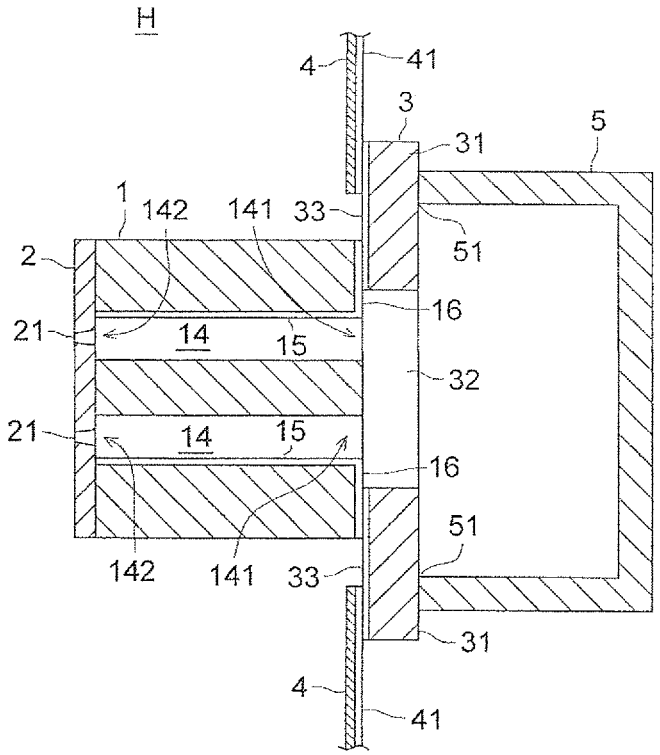
FIG. 2 is a cross sectional view showing an example of the inkjet head of the present invention.

The following describes the embodiments of the present invention with reference to drawings;

FIG. 1 is an exposed perspective view showing an example of the inkjet head of the present invention. FIG. 2 is a cross sectional view, wherein H denotes an inkjet head, numeral 1 is a head chip, numeral 2 is a nozzle plate connected to the front surface of the head chip 1, numeral 3 is a wiring substrate connected to the rear surface of head chip 1, numeral 4 is an FPC connected to the wiring substrate 3, and numeral 5 is an ink manifold connected to the rear surface of the wiring substrate 3.

In the present specification, the surface where ink is jetted from the head chip 1 is defined as a "front surface", and the opposite side thereof is defined as "rear surface". When head chip 1 is viewed from the front surface or rear surface, the outer surfaces on she top and bottom with the channel arranged, in parallel are called "top surface" and "bottom surface", respectively.

Driving wall 13 made of a piezoelectric element and a channel 14 are arranged alternately on head chip 1. Channel 14 is configured in such a way that the walls on both sides rise almost perpendicularly to the too surface and bottom surface, and are parallel to each other. As shown in FIG. 2, outlet port 142 and inlet port 141 of each channel 14 are arranged on the front surface and rear surface of the head chip 1. Further, each channel 14 is of a straight type wherein the size and shape remain almost unchanged along the length from inlet port 141 to outlet port 142.

In this head chip 1, each channel 14 has a channel array wherein two arrays are formed in the vertical direction in the drawing. Each channel array is composed of six channels 14. There is no restriction to the number of channels 14 constituting the channel array in head chip 1.

Figure 3:
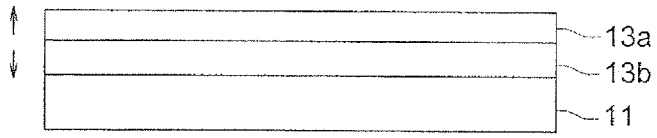
FIG. 3(*a*) through (*d*) show a method of producing a head chip.
Figure 3:
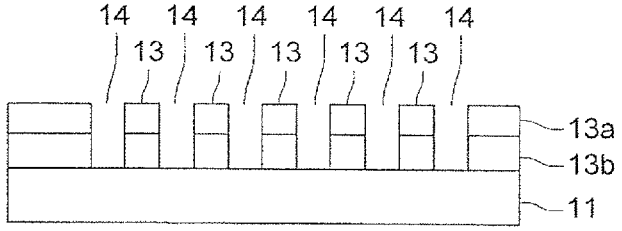
Figure 3:
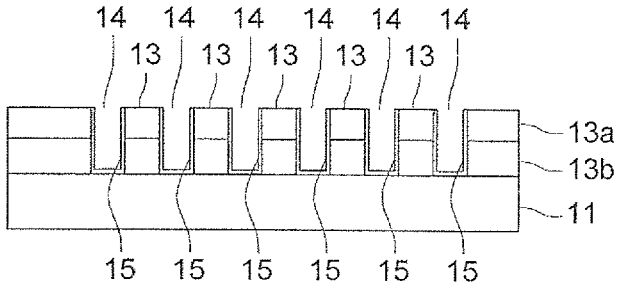
Figure 3:
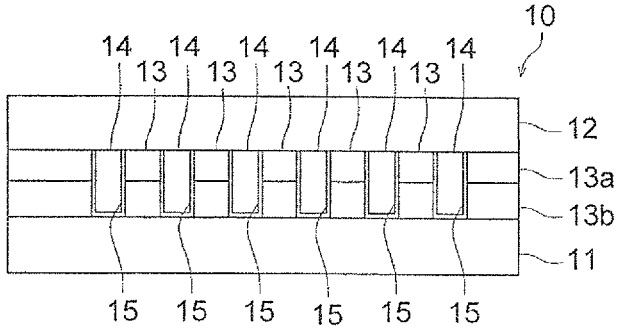
Figure 4:
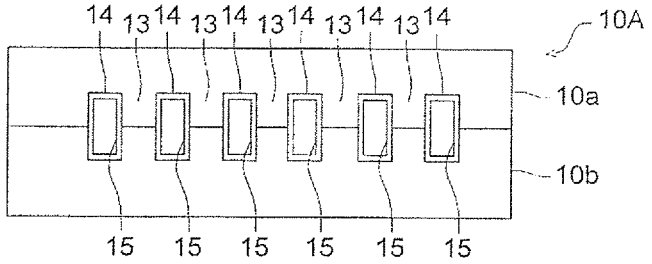
FIG. 4 is an explanatory diagram of another method of producing a head chip.

FIGS. 3 and 4 show an example of the method of producing such head chip 1.

Two piezoelectric element substrates 13*a* and 13*b* are bonded on one base substrate 11 using an epoxy based adhesive (FIG. 3(*a*)). The commonly known piezoelectric material wherein deformation is caused by application of voltage can be used as the piezoelectric material for piezoelectric element substrates 13*a* and 13*b*. The use of lead zirconate titanate (PZT) is particularly preferred. Two piezoelectric element substrates 13*a* and 13*b* are laminated each other with the opposite directions of polarization (indicated by arrow mark), and are bonded onto substrate 11 by an adhesive.

A plurality of parallel grooves are ground, over two piezoelectric element substrates 13*a* and 13*b* using the dicing saw. Thus, base substrate 11 is provided, with driving wall 13 made up of a piezoelectric element wherein the direction of polarization is opposed in the height direction. Each groove is ground at a predetermined depth from one end to the other end of piezoelectric element substrates 13*a* and 13*b*. This procedure forms straight channel 14 (FIG. 3 (*b*)) wherein the size and shape are kept almost unchanged along the length.

Although not illustrated, it is further possible to increase a thickness of piezoelectric element substrate 13*b* to eliminate substrate 11, wherein a plurality of channels whose depth reaches to the middle of thick piezoelectric element subs crate 13*b* are formed through grinding, thereby driving wall 13 in which the polarizing directions oppose each other, are formed, and aforesaid substrate 11 is substituted by piezoelectric element substrate 13*b*.

Next, driving electrode 15 is formed on an inside surface of each channel 14 formed in the above way. Metal materials to form the electrode are Ni, Co, Cu and Al. While Al and Cu are preferred from the viewpoint of electric resistance, Ni is preferably used in terms of corrosion, strength and cost. Also, a laminated structure where Au is laminated on Al can be employed.

While methods to form a metal film using a vacuum device such as evaporation coating method, spattering method, plating method and CVD (chemical vapor deposition method) are quoted as forming methods of driving electrode 15, plating method is preferred and forming by nonelectrolytic plating is particularly preferred. A metal film which is free from pin holes and uniform in thickness can be formed by nonelectrolytic plating. A thickness of plating film is preferred in a range of 0.5-3 μm.

Driving electrode 15 must be made independently for each channel 14. This makes it necessary to ensure that a metal film will not be formed on the top end surface of driving wall 13. For example, a dry film is bonded on the top end surface of the driving wall 13 in advance or a resist is formed. They are removed after formation of the metal film. Driving electrode 15 is formed selectively on the side of each driving wall 13 and on the bottom surface of each channel 14 (FIG. 3(*c*)).

After driving electrode 15 has been formed according to the aforementioned procedure, cover substrate 12 is bonded onto the top end surface of driving wall 13 by the epoxy based adhesive. Thus, head substrate 10 having a row of channels is formed (FIG. 3(*d*)). The same substrate material as the piezoelectric material constituting driving wall 13 is depolarized and is used as base substrate 11 and cover substrate 12. This will minimize the variations in velocity distribution and drive characteristics caused by the difference in thermal expansion coefficients resulting from heat produced at the time of substrate bonding or driving.

The aforementioned head substrate is not restricted to the one shown in FIG. 3(*d*). A piezoelectric element substrate having a greater thickness can be used instead of the base substrate 11, as shown in FIG. 4. Parallel grooves are ground, and driving wall 13 and channel 14 are arranged alongside alternately. Two substrates (upper substrate 10*a* and lower substrate 10*b*) are formed, wherein driving electrode 15 is formed on the inner surface of each channel 14. They are bonded together so that driving walls 13 will be opposite to each other, and head substrate 10A similar to the one shown in FIG. 3(*d*) can be produced. In this case, there is no need of bonding piezoelectric element substrate 13*a* as thin as in FIG. 3(*a*) onto piezoelectric element substrate 13*b*, and this arrangement is preferable from the viewpoint of cost reduction. The following describes a case of using head substrate 10 of FIG. 3(*d*).

Figure 5:
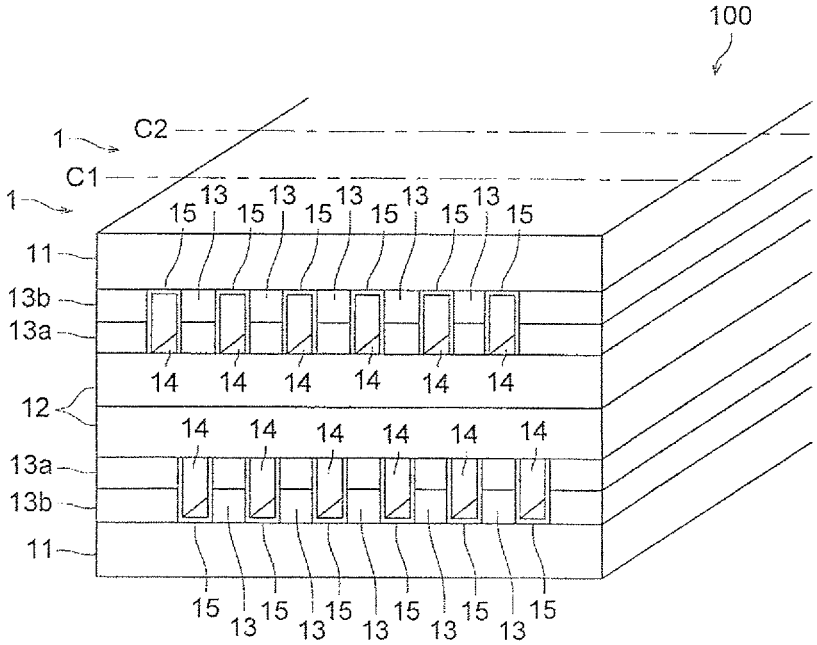
FIG. 5 is an explanatory diagram or a method of producing a head chip from one head substrate.

Two head substrates 10 produced as shown in FIG. 3(*d*) are used, and cover substrates 12 are placed one on top of the other, as shown in FIG. 5. They are bonded by epoxy based adhesives to produce laminated head substrate 100 having two arrays of channels on the top and bottom. This laminated head substrate 100 is cut off along a plurality of cut-lines C1, C2, etc, in the direction perpendicular to the length of channel 14, thereby manufacturing a plurality of harmonica type head chips 1.

In head chips 1 formed in this procedure, driving wall 13 made of a piezoelectric element and channel 14 are arranged alongside alternately in each array of channels. Channel 14 is configured in such a way that walls on both sides rise almost perpendicularly to base substrate 11 of head chip 1, and are parallel to each other. Outlet port 142 and inlet port 141 of each channel 14 are arranged on the front surface and rear surface of head chip 1. Each channel 14 is a straight type channel wherein the size and shape remain almost unchanged in the direction from the inlet to the outlet ports.

To ensure that a wire of the FPC or the like for applying the driving voltage from the driving circuit to the driving electrode 15 inside each channel 14 can be connected from the outside, each driving electrode 15 must be extended to the outer surface of head chip 1 in the aforementioned harmonica type head chip 1. For this purpose, connection electrode 16 is extended to the rear surface of head chip 1 over the distance from the portion of driving electrode 15 formed on bottom of the channel 14 (the surface of base substrate 11 facing inside channel 14) to the rear end surface of base substrate 11.

Figure 6:
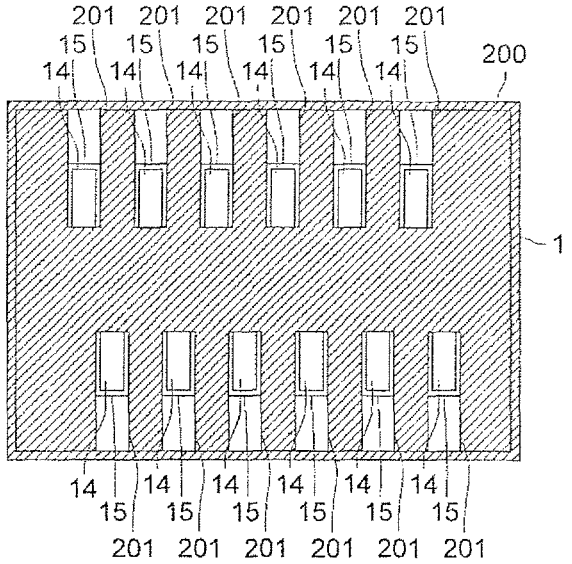
FIG. 6(*a*) through (*b*) are explanatory diagrams showing a method of forming a connection electrode.
Figure 6:
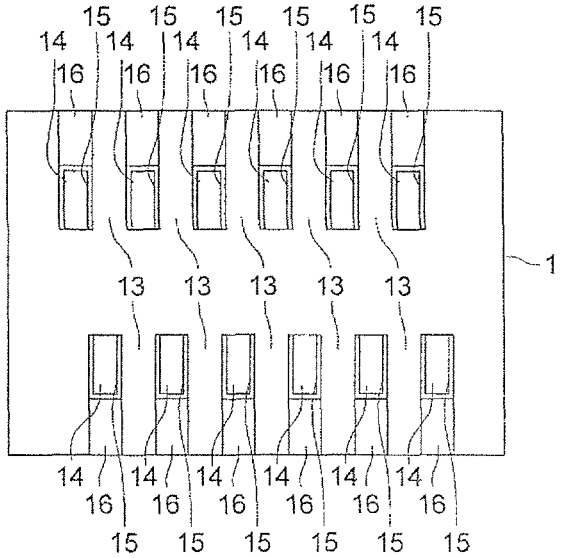
Figure 7:
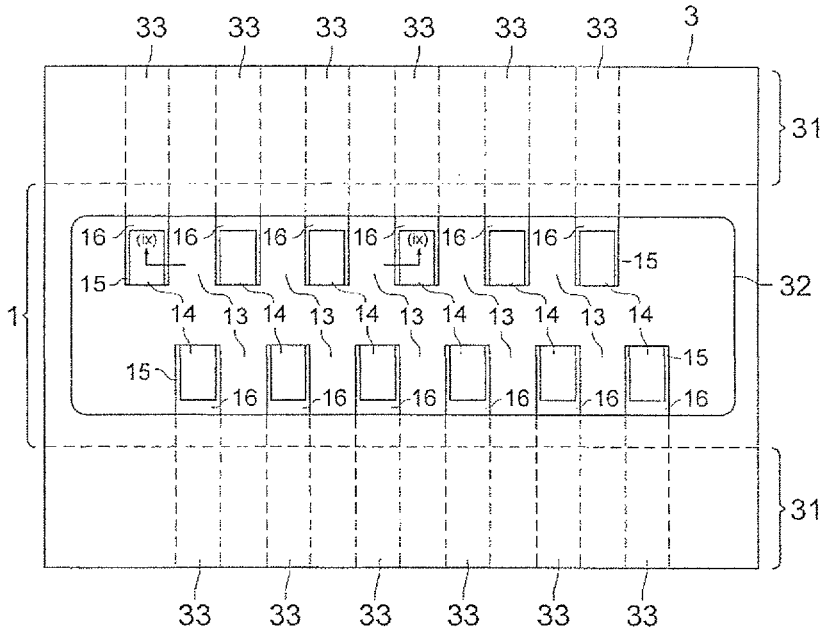
FIG. 7 is a rear side view showing that a wiring substrate is connected to the head chip.

FIGS. 6(*a*) and (*b*) show an example of the method of extending connection electrode 16 to be connected electrically with each driving electrode 15, to the outer surface of head chip 1.

As FIG. 6(*a*) snows, connecting electrode 16 can be formed through the step, wherein photo sensitive dry film 200 having opening section 201 which exposes the rear end surface of substrate 11 including at least a portion of drive channel 15 formed on the a surface of base substrate 11 exposed inside of channel 14, is affixed on one of cutting surfaces (rear surface) of head chip 1, and a metal film is created in opening section 201 by evaporating a metal such as Al for forming electrode.

To ensure smooth connection between driving electrode 15 inside channel 14 and connection electrode 16*b* vapor deposition is preferably performed at a predetermined inclination, without the rear surface of head chip 1 being perpendicular to the direction of vapor deposition. To put it more specifically, without being perpendicular to the sheet surface in FIG. 6(*a*), the direction of vapor deposition (wherein the metallic particle comes flying) is preferably about 30 through 60 degrees included from the perpendicular line toward the top and bottom.

Connection electrode 16 can be formed in a lamination structure using the method of evaporating gold onto an aluminum metal film. Further, connection electrode 16 can be formed by sputtering instead of vapor deposition.

When cutting operation is made by using head substrate 10A especially wherein head chip 1 is formed as shown in FIG. 4, driving electrode 15 of upper substrate 10*a* and that of lower substrate 10*b* are not electrically connected since an adhesive is present between them. When a metal film is formed inside the opening of photo sensitive dry film 200, it is necessary to ensure connection of these two driving electrodes 15, 15. When vapor deposition is used for electrode formation, vapor deposition is performed several times in a predetermined direction or direction of the substrate is changed during the vapor deposition. When, the sputtering method is used to form an electrode, the metal particles will fly in various directions. Connection of two driving electrodes 15, 15 can be achieved without changing the direction of the substrate particularly.

Opening 201 is preferably opened over all the surfaces of channel 14, with due consideration given to workability in the development and rinsing steps for photo sensitive dry film 200. The opening over all the surfaces of channel 14 facilitates removal of the developing solution and rinsing water from channel 14.

After that, photo sensitive dry film 200 is removed. Then, as shown in FIG. 6(*b*), connection electrode 16 electrically connected with driving electrode 15 from each channel 14 is extended onto the rear surface of head chip 1 independently for each channel.

Nozzle plate 2 is provided with a nozzle 21 at the position corresponding to each channel 14 or the head chip 1. An epoxy based adhesive is used to bond nozzle plate 2 so the front surface of head chip 1 with connection electrode 16 formed thereon.

Wiring substrate 3 is a plate-formed member to connect a wire which applies driving voltage from the driving circuit (not illustrated) to each driving electrode 15 of head chip 1. A substrate made of such a ceramic material as non-polarized PZT, AlN-BN and AlN, a substrate made of plastic or glass of low thermal expansion, and a substrate produced by depolarization of the same substrate material as that of the piezoelectric element used in head chip 1 can be used as the substrate used in this wiring substrate 3. To reduce the distortion of head chip 1 caused by the difference in thermal expansion it is preferred to select the material so as to ensure that the difference in thermal expansion coefficient from that of head chip 1 is fall within the range of ±1 ppm, The substrate constituting wiring substrate 3 is not restricted to a single plate formed substrate. It is possible to produce a substrate having a predetermined thickness by lamination of a plurality of sheet-like substrate materials.

Wiring substrate 3 has the same width as that of head chip 1. It extends in the direction (vertical direction in FIGS. 1 and 2) perpendicular to the direction wherein channels 14 or head chip 1 are arranged (direction of channel array), and heavily extends from the top surface and bottom surface of head chip 1. The ends of the extension are used as wiring connections 31 for connection of the FPCs 4, 4.

Opening 32 is formed by penetration through the center of wiring substrate 3. This opening 32 is formed to have such a site as to expose the inlet port 141 side of all channels 14 of head chip 1. Thus, when wiring substrate 3 is connected to the rear surface of head chip 1, all driving walls 13 of head chip 1, all channels 14 and all driving electrodes 15 cars be viewed through this opening 32, as shown in FIG. 1.

Depending on the characteristics of the substrate material, opening 32 can be formed by the method of using a dicing saw for processing, the method of using an ultrasonic processing machine, or the method of molding a ceramic and sintering.

Wired electrodes 33 are formed on the surface representing the side to be connected with head chip 1 of wiring substrate 4 in the same number and at the same pitch as those of connection electrode 16 formed on the rear surface of the head chip 1. These electrodes extend to reach the wiring connections 31. When connected with the FPC4, this wired electrode 33 is electrically connected with wire 41 formed on the FPC4, and works as an electrode for ensuring that the driving voltage from driving circuit supplied through wire 41 of the FPC4 is applied to driving electrode 15 inside channel 14 through connection electrode 16.

Wired electrode 33 is formed as follows: Positive resists are coated on the surface of wiring substrate 3 according to the spin coating method. The positive resists are then exposed by a striped mask and are developed, whereby the surfaces of wiring substrate 3 are exposed in the same number and at the same pitch as those of connection electrode 16 between the striped positive resists. A metal film is formed on the surface thereof by the vapor deposition or sputtering method using an electrode forming metal. The same metal as that of connection electrode 16 can be used as an electrode forming metal.

In wiring substrate 3, each wired electrode 33 is electrically connected with each connection electrode 16 of head chip 1 and, at the same time, opening 32 is positioned in such a way as to expose inlet 141 port side of all channels 14 of head chip 1. Wiring substrate 3 is bonded on the rear surface of head chip 1 by the anisotropic conductive film. The other methods of electrical connection include the method used in the conventional packaging technology such as the pressure bonding method using an anisotropic conductive paste including the conductive particles, and non-conductive adhesive, and the method of bonding by heating and melting through the use of solder for at least one of wired electrode 33 and connection electrode 16.

As described above, the wiring substrate 3 is bonded to the rear surface of head chip 1. This allows the electrodes (connection electrode 16 and wired electrode 33) to be extended in the direction perpendicular to the channel array, wherein these electrodes are used to apply the driving voltage from the driving circuit to driving electrode 15 in each channel 14 inside head chip 1. Of these electrodes, wired electrode 33 is extended to wiring connections 31 which largely protrudes from the bead chip 1. This arrangement facilitates electrical connection with the FPCs 4, 4. Even when the FPCs 4 are connected, the aforementioned FPCs 4, 4 are not present on the rear side of head chip 1. This creates a large open space on the rear of head chip 1.

Ink manifold 5 reserves the ink to be supplied no each channel 14 of head chip 1, through opening 32 of wiring substrate 3. Ink manifold 3 is formed in a box-like structure, and opening 51 is connected so as to cover opening 32 formed on wiring substrate 3.

Opening 51 of this ink manifold 5 including opening 32 of wiring substrate 3 has a size sufficient to reach each of the extensions 31, 31. Opening 31 is greater than the ream: surface of head chip 1. As described above, even in she connection of ink manifold 5, it is possible reserve a greater amount of ink than the size of head chip 1 by using extensions 31, 31 of wiring substrate 3. Ink is supplied into ink manifold 5 from ink supply inlet 52.

When wiring substrate 3 has a sufficient thickness, the inferior of opening 32 can be used, as a common ink chamber no supply ink to all channels 14, by closing opening 32 of wiring substrate 3 except for the ink supply inlet, instead of installing ink manifold 5.

The following describes the method of adjusting the shear deformation function of the driving wall from the side of the rear surface of head chip 1 to ensure uniform channel characteristics in the aforementioned inkjet head H.

In this case, no restriction is imposed on the channel characteristic which relates to the velocity distribution of irk jetted from the inkjet head H, as far as it is measurable. The channel characteristics are preferably measured by actually letting ink from each nozzle 21, because the measurement is made with higher precision. For example, the velocity, volume and diameter of the ink particle are preferably measured, as will be described below.

The following describes the procedure of measuring the velocity distribution of the ink particle jetted from each of nozzles 21, and adjusting the shear deformation function of driving wall 13 so that the velocity distribution will be uniform.

Figure 8:
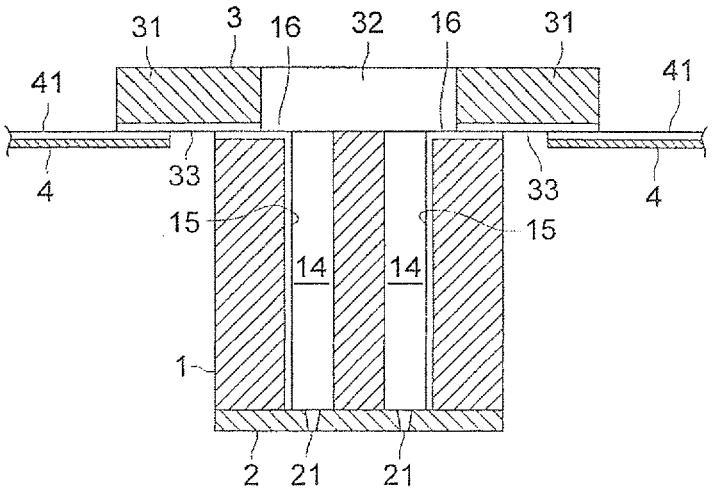
FIG. 8 is a cross sectional view showing a step of processing to weakening the shear deformation function of a driving wall.

In the process of manufacturing the inkjet head H, nozzle plate 2, wiring substrate 3 and FPCs 4, 4 is connected to head chip 1 having been manufactured. Then the driving voltage is applied to each driving electrode 15 from the driving circuit (not illustrated) through FPCs 4, 4, and driving is enabled, as shown in FIG. 8. After the process of manufacturing has advanced to this stage, ink is supplied to each channel 14 through opening 32 of wiring substrate 3, For example, ink can be supplied as follows: A temporary ink supply member having a size sufficient to cover opening 32, or ink manifold 5 is pressure-bonded to wiring substrate 3 so that ink will not leak, or is temporarily clamped using an adhesive that can be removed.

As described above, after ink is supplied to each channel 14 of head chip 1, a common driving voltage is actually applied to driving electrode 15 of each channel 14. Then driving wall 13 is shear deformed and ink is jetted from each nozzle 21. The ink droplet emission velocity at this time is measured, whereby the velocity distribution of all nozzles 21 is obtained.

No restriction is imposed on the method of measuring the ink emission velocity. For example, the ink jetted from nozzle 21 is photographed and an image is identified based on the ink photographed position, whereby the velocity is obtained through calculation. Alternatively, the optical axis of a detection sensor is arranged along the ink jetting path, and a step is taken to measure the change in the amount of light, of the light receiving sensor at the time of ink passing through the optical axis. The velocity is calculated from the timing of ink jetted and that of detection.

After measurement, of the velocity distribution, the temporary ink supply member or ink manifold 5 is removed. If there is a variation in the ink emission velocity among channels 14, processing is performed from the rear surface of head chip 1 to weaken the shear deformation function of driving wall 13 in such a way as to reduce the ink jetting velocity of channels 14 where the ink jetting velocity is higher. Processing of the rear surface of the head chip 1 is very easy because all driving walls 13, channels 14 and driving electrodes 15 are exposed through opening 32 of wiring substrate 3, and the space on the back of head chip 1 is wide open. Further, even if the temporary ink supply member or ink manifold 5 has been removed, any wire disconnection does not occur because the temporary ink supply member or ink manifold 5 is not an electrically connected component.

The following describes the procedure of measuring the volume distribution of the ink particle jetted from nozzle 21 and adjusting the shear deformation function of driving wall 13 so that, the volume distribution will be uniform.

Similarly to the aforementioned procedure, after the manufacturing process has advanced to the stage illustrated in FIG. 8, ink is supplied to each channel 14 through opening 32 of wiring substrate 3.

After the supply of ink to each channel 14 of head chip 1 has been enabled, a common driving voltage is actually applied to driving electrode 15 of each channel 14, and driving wall 13 is shear-deformed. Ink is then jetted from each nozzle 21, and the volume of ink particle at this time is measured, thereby the volume distribution of all nozzles 21 is obtained.

Assuming that $V_0$ is the volume of ink particles, r is the radius of a nozzle, V is the emission velocity, and ω is drive frequency, the following equation is obtained: $V_0=\pi r\times r\times V/(2\omega)$. The nozzle processing precision is sufficiently high and the nozzle radius as the same for any channel. Thus, measurement of the ink particle volume $V_0$ reveals jetting velocity distribution.

There is no restriction to the method of measuring the ink particle volume. Ink is jetted from the same nozzle by a predetermined amount (for a predetermined time), and the weight of all the ink having been jetted is measured. This arrangement, provides measurement of ink particles. For example, if the average ink particle is 10 ng and the drive frequency is 10 kHz, 10 ng×10 k Hz×10=1 mg, when jetting time is 10 sec. Ink particle volume can be obtained by measuring this weight using a weighing machine.

After measurement of ink particle volume distribution in this manner, the aforementioned procedure is taken. If there are variations in ink particle volume among channel 14, processing is performed from the rear surface of head chip 1 so as to reduce the shear deformation function of the driving wall 13, thereby reducing the ink particle jetting volume of channels 14 that jet greater volume of ink.

The following describes the method of measuring the diameter distribution of the ink particle jetted from nozzle 21 and adjusting the shear deformation function of driving wall 13 to make the diameter distribution uniform.

In this case as wall, the aforementioned procedure is taken. After the process of manufacturing has reached the stage as shown in FIG. 8, ink is supplied to each channel 14 through opening 32 of wiring substrate 3.

After supply of ink of head chip 1 to each channel 14 has been enabled, a common driving voltage is actually applied to driving electrode 13 of each channel 14. Then, driving wall 13 is shear-deformed and ink is supplied from each nozzle 21. The diameter of the ink particle at this time is measured to obtain the diameter distribution of all nozzles 21.

No restriction is imposed on the method of measuring the ink particle diameter. For example, the ink particle jetted from nozzle 21 is photographed and ink particle diameter is measured on the image.

If there is a variation in ink particle diameter among channels 14 after the measurement of the ink particle diameter distribution, the same step as in the aforementioned procedure is taken. Namely, processing is performed from the rear surface of head chip 1 to weaken the shear deformation function of driving wall 13 in such a way as to reduce the diameter of channel 14 that jets the ink particle of greater diameter.

Figure 9:
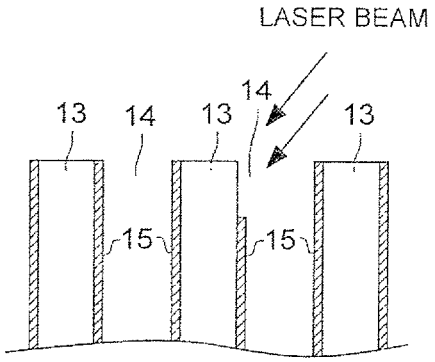
FIG. 9(*a*) through (*d*) are cross sectional views along lines (ix) through (ix) in FIG. 7.
Figure 9:
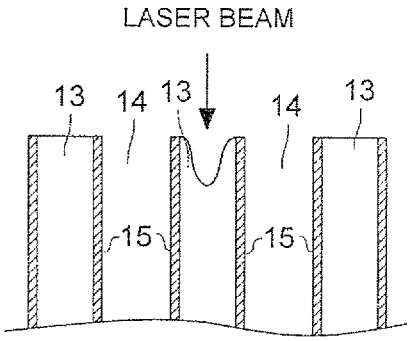
Figure 9:
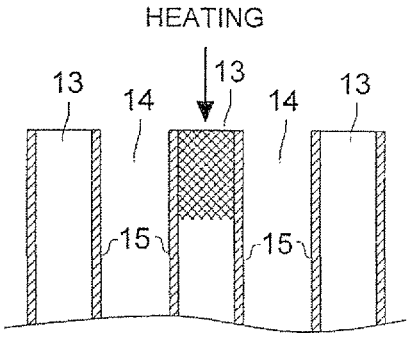
Figure 9:
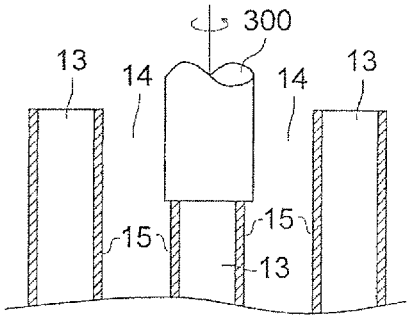

To weaken the shear deformation function of driving wall 13, for example, a laser is used to remove a part of driving electrode 13 formed on the surface of driving wall 13, as shown in FIG. 9(*a*).

A preferably used laser includes an excimer laser, double-frequency laser using SHG or triple frequency laser. As illustrated, a laser bears is applied in a slanting direction from the inlet port 141 side of channel 14, thereby removing part of driving electrode 15 of the intended driving wall 13. Driving wall 13 consisting of a piezoelectric element is shear-deformed by the potential difference in the voltages applied to driving electrodes 15 on both surfaces. Reduction in the area of driving electrode 15 leads to reduction in the sensitivity of driving wall 13, with the result that the amount of shear deformation of driving wall 13 is decreased, and hence the ink emission velocity is lowered.

By way of an example, in the head chip 1 where the length (L) of the channel 14 in the direction ink emission is 2.5 mm, 1% reduction driving electrode 15 will be achieved, if driving electrode 15 is removed to a depth of 25 μm from the inlet port 141 of channel 14. In actual practice, the amount of driving electrode 15 having been removed, and the level of reduction in sensitivity are measured in advance. Based on this data, the amount of driving electrode 15 to be removed is determined.

The amount of shear deformation can also be reduced by removing part of driving wall 13 per se. One of the methods of weakening the shear deformation function of driving wall 12 is to remove part of driving wall 13 by laser processing, as shown in FIG. 9(*b*). The same type or laser as that used in removing the driving electrode 15 can be used. In this case as well, reduction in the amount of driving wall 13 to be removed and sensitivity is measured to some extent in advance. Based on this data, the amount of driving wall 13 to be removed should be determined.

The polarized piezoelectric element is depolarized by heating. The depolarized piezoelectric element has the shear deformation function weakened by reduction in sensitivity. One of the methods of weakening the shear deformation function of driving wall 13 is to heat the driving wall 13 from the side of the rear surface of the head chip 1, as shown in FIG. 9(*c*). Use of a laser is preferred for heating, since only the relevant driving wall 13 can be heated in a form of spot. If the laser is applied to such an extent that driving wall 13 is not removed, driving wall 13 can be heated and the sensitivity can be reduced.

No restriction is imposed on the type of the laser that can be used in the aforementioned case. An infrared semiconducting laser or YAG laser is preferably used for this purpose. The level of reduction in the sensitivity of driving wall 13 is the greatest at a portion where the laser beam is irradiated, and is decreased as going away from that portion. This level depends on the material quality and thickness of driving electrode 15 and driving wall 13. Thus, in this case as well, the level of heating driving wall 13 (heating temperature and time) and the level of reduction in sensitivity are measured to some extent in advance. Based on this data, the level of heating driving wall 13 to be heated should be determined.

Another way of processing to weaken the shear deformation function of the driving wall 13 is to mechanically process driving wall 13 per se from the rear surface of head chip 1. FIG. 9(*d*) shows the way of mechanically reducing the sensitivity by removing part of driving wall 13. Mechanical processing is provided by grinding driving wall 13 from the rear, surface of head chip 1 using end milling cutter 300. In this case as well, the amount of machining driving wall 13 and the level of sensitivity reduction are measured to some extent in advance. Based on this data, the amount of machining driving wall 13 should be determined.

As described above, when adjusting the shear deformation function of driving wall 13, the metal has been evaporated may deposit on nozzle 21 if a laser beam is used for processing. If machining operation is used, nozzle 21 may be clogged with chips. To avoid possible damages to nozzle 21, a removable protection agent is preferably applied to nozzle 21 in advance. The removable protection agent is preferably exemplified by an organic high molecular film such as a resist that can be removed by organic solvent.

The inkjet head wherein driving walls 13 and channels 14 are arranged alongside alternately is available in two types.

One is a three-cycle head type wherein all the channels 14 are used as ink jetting channels, and adjacent channels 14 are sequentially driven in three cycles. The other is an independent channel type wherein channels 14 are divided into ink jetting channels and air channels which are arranged alternately.

In the case of a three-cycle head type, one driving wall 13 is shared by two adjacent channels 14. If the sensitivity of one of driving walls 11 is weakened, the velocity of the ink jetted from two channels 14 on both sides of driving wall 13 will be affected. Generally, lack of uniformity in the channel characteristics such as velocity distribution is often caused by driving wall 13. Thus, the aforementioned procedure is sufficient to provide uniform channel characteristics. However, lack of uniformity in the channel characteristics is caused by other than driving wall 13 in some rare case. In this case as well, lack of uniformity in the channel characteristics will be improved.

In the meantime, for the independent channel type, driving wall 13 is devoted solely to one ink jetting channel, and is not shared by others. In this case, processing of driving wall 13 affects only channel 14 to which the wall is solely devoted. This arrangement provides complete adjustment of the channel characteristics.

Figure 10:
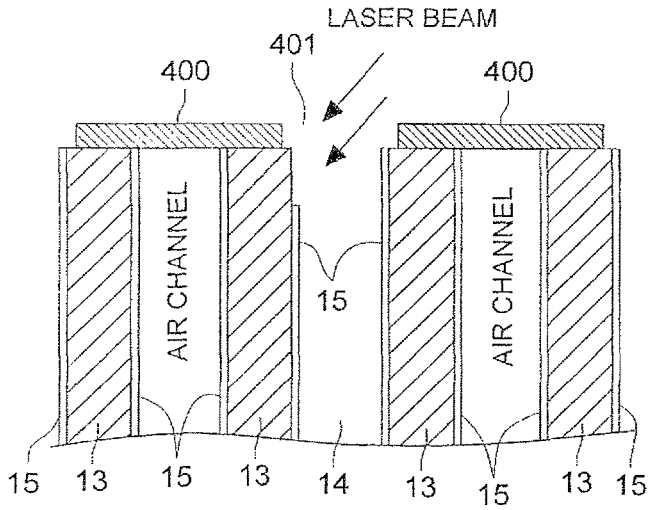
FIG. 10 is a cross sectional view along the array of channels showing a step of processing so weaken the shear deformation function of the driving wall in an independent channel type.

In the case of this independent channel type, some means must be taken to ensure that ink does not enter the air channel. This is achieved by the following arrangement: The ink jetting channel is normally provided with an ink supply hole 401 on the rear surface of the head chip, as shown in FIG. 10. By contrast, the air channel is provided with hole-less plate 400 to ensure that ink does not flow therein.

After this plate 400 has been provided, channel characteristics such as velocity distribution are measured. When processing is made from the rear surface of head chip 1, ink supply hole 401 of plate 400 is formed to have an area greater than the inlet area of channel 14. The laser beam is applied in a slanting direction, as shown in FIG. 9(*a*), whereby driving electrode 15 is removed. Alternatively, driving wall 13 is heated by application of the laser beam, whereby processing can be made. The method shown in FIGS. 9(*b*)) and 9(*d*) cannot be easily used to this case.

In the above description, nozzle place 2 is connected to the front surface of head chip 1, and ink is jetted from nozzle 21. The channel characteristics such as velocity distribution are measured. The structure of the inkjet head H of the present invention allows the channel characteristics to be measured, without the ink being jetted.

Figure 11:
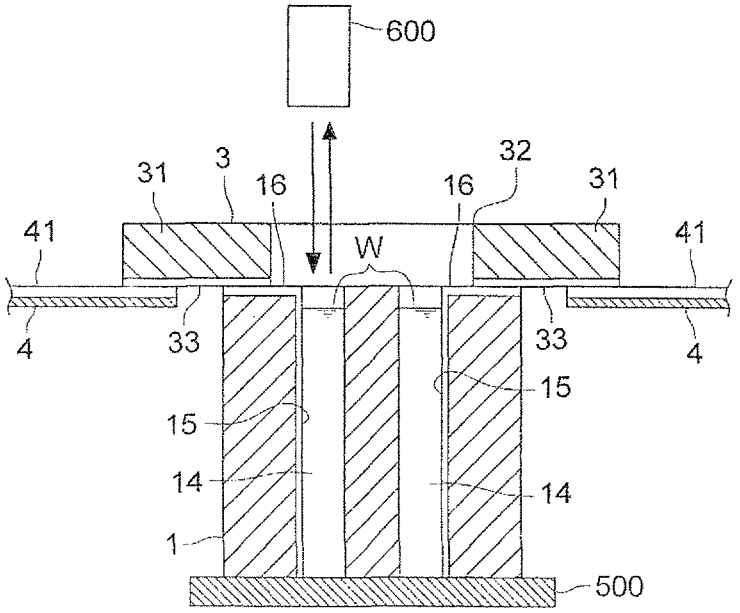
FIG. 11 is a cross sectional view showing an example of a method of measuring the channel characteristics without ink being jetted.

FIG. 11 is a cross sectional view showing an example of the method of measuring the channel characteristics, without the ink being jetted.

If wiring substrate 3 and FPCs 4, 4 have been connected, head chip 1 allows driving voltage to be applied to each driving electrode 15. Thus, wiring substrate 3 and FPCs 4, 4 are connected to head chip 1 with connection electrode 16 formed thereon. After the process of manufacturing has advanced to the stage where the nozzle plate is yet to be connected, the front surface of head chip 1 is closed. In this case, the cover member 500 is bonded to the front surface of head chip 1 by the adhesive that can be removed later. Alternatively, the front surface of head chip 1 can be pressed against an elastic member and others to seal outlet port 142 side of channel 14.

After that, the front surface of head chip 1 is placed to face downward, and each channel 14 is filled with liquid W. A common driving voltage is applied to driving electrode 15 of each channel 14, whereby driving wall 11 is shear-deformed. A nonvolatile liquid is preferably used as the liquid W filled into each channel 14. For example, oil based ink can be mentioned.

If the driving voltage is applied to driving electrode 15, driving wall 13 will be shear-deformed in a dog-legged form to reduce or expand the capacity in channel 14. This will allow the level of the liquid W filled in channel 14 to move in the vertical direction. A laser Doppler velocimeter 600 is used to measure the behavior of the level of liquid W. This procedure permits the characteristics of each channel 14 to foe measured. The velocity distribution of all channels 14 can be estimated from the channel characteristics.

After measurement of the channel characteristics of all channels 14, the shear deformation function of driving wall 13 should be adjusted from the rear surface of head chip 1. Nozzle plate 2 can be connected either before or after processing. From the viewpoint of protection of nozzle 21, it is preferably connected after processing.

In an independent channel type wherein the ink jetting channels and air channels are arranged alternately, if the characteristics of each channel 14 are to be obtained before nozzle plate 2 is bonded in this method, only the ink emission channel should be filled with liquid W. This can be done by using the inkjet head to fill only the channel for jetting liquid W. In this case as well, use of the methods given in FIGS. 9(*b*) and 9(*d*) will make it difficult to bond plate 400 for blocking the rear end, as shown in FIG. 10. Accordingly, the method given in FIGS. 9(*a*) and 9(*c*) is preferably utilized.

Further, when jetting the liquid that corrodes driving electrode 15 as in the case of water-based ink, it is necessary to form a protective film that protects each driving electrode 15, for example, a polyparaxylene film can be used as a protective film.

If processing is performed to weaken the shear deformation function subsequent to formation of a polyparaxylene film as protective film, the function of the protective film may deteriorate. The polyparaxylene film is formed by CVD (chemical vapor deposition) and is deposited on all the surfaces of head chip 1. It is not preferred that nozzle plate 2 should be bonded onto head chip 1 when the protective film is formed. Thus, when a protective film is formed, a channel characteristics are measured by laser Doppler velocimeter 600 before nozzle plate 2 is bonded, as shown in FIG. 11. After that, processing is performed to adjust the shear deformation function, and a protective film is then formed. After that, nozzle plate 2 is bonded. Use of this procedure is preferred. Alternatively, in order to measure the channel characteristics, nozzle plate 2 is bonded temporarily. After the measurement nozzle plate 2 is removed, end processing is performed to adjust the shear deformation function. After the protective film is formed, the nozzle plate 2 is bonded on a permanent basis.

When a film of high heat resistance such as a silicon oxide film or silicon nitride film is used as a protective film, a protective film is formed and the nozzle plate 2 is bonded. Then the channel characteristics is measured and a laser beam is applied to heat driving wall 13. Thus, processing can be performed to adjust the shear deformation function without affecting the appearance.

Upon completion of the processing of driving wall 13 to ensure uniform channel characteristics, ink manifold 5 is bonded to wiring substrate 3 as required, whereby formation of the inkjet head H is completed.

Another example of the way of measuring the channel characteristics without ink being jetted is to measure the capacity distribution of driving wall 13 of each channel 14.

Figure 12:
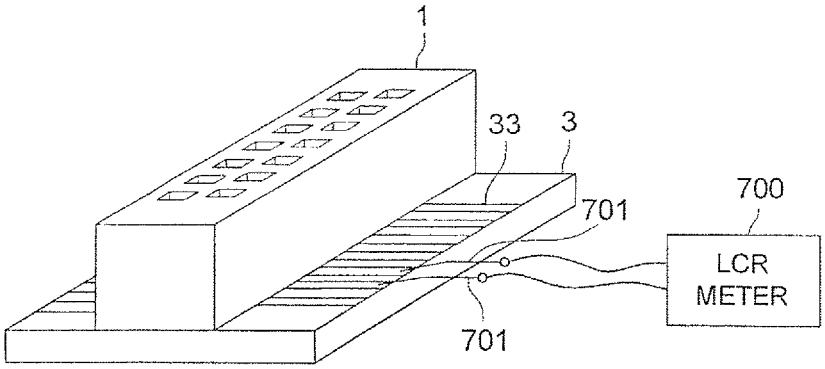
FIG. 12 is a perspective view showing another example of the method of measuring the channel characteristics, without the ink being jetted.

To measure the capacity of driving wall 13, two or ones 701, 701 connected to the LCR meter 700 are brought into contact with adjacent wired electrode 33, as shown in FIG. 12. This makes it possible to measure the capacity of driving wall 13 provided with driving electrode 10 electrically connected to the aforementioned two wired electrodes 33. Use of the automatic stage for this measurement under the computer control will facilitate the measurement of the capacity of ail driving walls 11. The velocity distribution of all channels 14 can be estimated from this capacity distribution.

Subsequent to measurement of the capacity of all channels 14, the shear deformation function of driving wall 13 can be adjusted from the rear surface of head chip 1, based on the capacity distribution.

The aforementioned, measurement of the channel characteristics and adjustment of the shear deformation function of driving wall 13 are preferably repeated several times as required. This further improves the effect of making the channel characteristics uniform.

Figure 13:
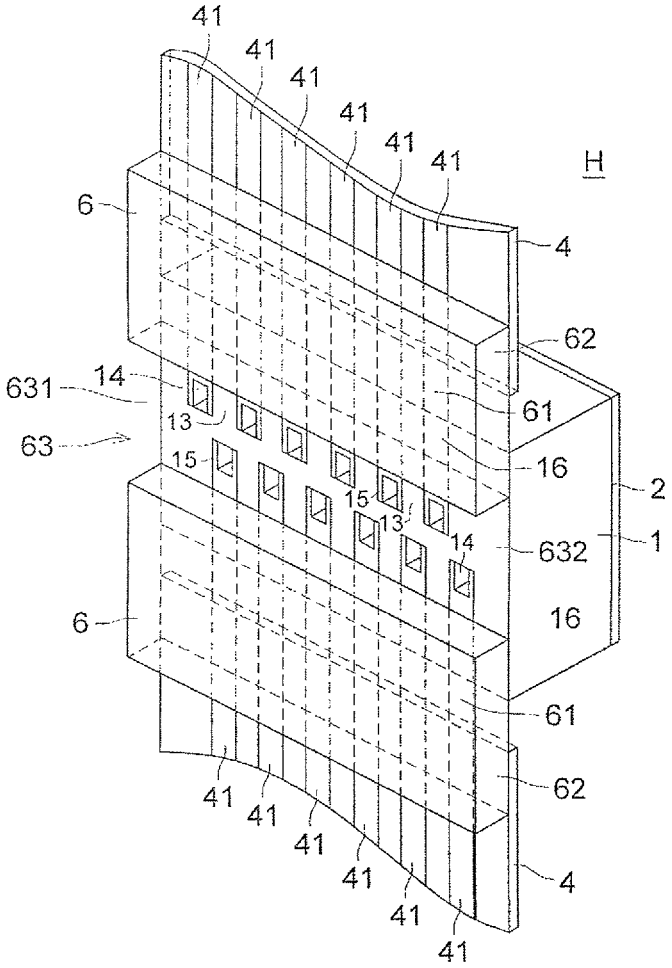
FIG. 13 is a perspective view showing another embodiment of the wiring substrate, as viewed from the rear side.

FIG. 13 shows another embodiment of the wiring substrate. The components having the same reference numerals in FIGS. 1 and 2 have the same configuration and the details thereof will not be described here.

This wiring substrate is made of two independent substrates 6, 6 arranged on two channel arrays of head chip 1. The same substrate as that of wiring substrate 3 can be used as the substrate constituting wiring substrates 6, 6, In each of wiring substrates 6, 6, wired electrode 61 corresponding to connection electrode 16 of the aforementioned head chip 1 is formed on the surface bonded with head chip 1. One of the ends is bonded to the area forming connection electrode 16 of the each channel array of the rear surface of head chip 1 in such a way that each wired electrode 61 is electrically connected with each connection electrode 16. The other end extends in the direction perpendicular to the channel array. The ends of this extension form wiring connections 62, 62. Each of wires 11 of the FPCs 4, 4 is bonded so as to foe electrically connected with each of wired electrodes 61.

Wiring substrates 6, 6 are arranged separately from each other, with space section 63 located in-between. All driving walls 13, channels 14 and driving electrodes 15 facing the rear surface of head chip 1 are exposed to space section 63. Similarly to the above, this makes it easier to perform processing so as to adjust the shear deformation function or each driving wall 13 through space section 63 from the rear surface of head chip 1, after the channel characteristics have been measured by actually jetting ink or without jetting ink.

The aforementioned wiring substrates 6, 6 contribute to further cost cutting, because it allows use of a substrate of simple structure, and does not required opening 32 to be processed, as in the case of wiring substrate 3. Each of wiring substrates 6, 6 can be bonded independently to head chip 1. The electrical connection between wired electrode 61 and connection electrode 16 for one of wiring substrates 6 does not affect that for the other wiring substrate 6. This arrangement ensures a reliable electrical connection free from the risk of short-circuiting.

When wiring substrates 6, 6 have a sufficient thickness, pace section 63 between wiring substrates 6, 6 can form a common ink chamber to be shared by all channels 14 of head chip 1. Wiring substrates 6 can be further connected with an ink manifold 5.

On sections 631 and 632 on both sides of space section 63 can be closed by a member (not illustrated), or can be used as an ink supply inlet or ink outlet. When space section 63 is used as a common ink chamber, open section 631 can be used as an ink supply inlet, and open section 632 can be used as an ink outlet so that ink will circulate through the common ink chamber.

As described above, in inkjet head H, wiring substrates 3 and 6 are made of a plate-formed substrate, and wiring connections 31 and 62 are connected with an FPC 4. Wiring substrates 3 and 6 per se can be formed of an FPC. Then both the connection between the head chip 1 and wiring substrate, and the connection of a wire to supply the driving voltage to each of driving electrodes 15 can be made at one time, with the result that at the number of man hours is cut down.

The above description of head chip 1 of inkjet head H refers to the case of two channel arrays. The number of the channel arrays can be one or more than two.

What is claimed is:

1. An inkjet head comprising:

a head chip having a front surface and a rear surface, the front surface being opposite the rear surface, driving walls composed of piezoelectric element, wherein shear deformation is caused by applying voltage so as to jet ink from nozzles, channels arranged alongside the driving walls alternatively to contain ink to be jetted, outlet ports and inlet ports respectively provided on the front surface and the rear surface of the head chip for each channel, driving electrodes formed on surfaces of the driving walls to apply voltage to the driving walls, and connection electrodes connected to the driving electrodes electrically and formed on the rear surface of the head chip;

a wiring substrate having wiring electrodes formed thereon to apply voltage from a driving circuit to the driving electrodes through the connection electrodes, the wiring substrate being bonded on the rear surface of the head chip so as to protrude from the head chip in a direction perpendicular to a direction of a channel array so that all the channels are exposed at the rear surface of the head chip.

2. The inkjet head of claim 1, further comprising:

an opening section provided to the wiring substrate in an area corresponding to a channel array of the head chip so as to expose all the channels.

3. The inkjet head of claim 1, wherein an end of the wiring substrate on which wiring electrodes are formed to apply voltage from a driving circuit to the driving electrode through the connection electrode, is bonded on a forming area of the connection electrodes so that all the channels of the head chip are exposed, and the other end of the wiring substrate protrudes from the head chip in a direction perpendicular to a direction of a channel array.

4. The inkjet head of claim 1, wherein the protruding end of the wiring substrate represents a wiring connection section on which a FPC (flexible printed circuit) is connected to apply voltage from the driving circuit through the FPC.

5. The inkjet head of claim 1, wherein the wiring substrate is composed of FPC.

6. The inkjet head of claim 2, further comprising an ink manifold which supplies ink to each channel of the head chip, wherein the ink manifold includes an opening greater than the rear surface of the head chip and connected to the wiring substrate so as to cover the opening of the wiring substrate.

7. The inkjet head of claim 6, wherein the opening of the ink manifold has a size including the opening of the wiring substrate and extending to a protruding portion of the wiring substrate.

8. The inkjet head of claim 2, wherein the opening section is formed through a center of the wiring substrate and all inlet ports lead into the opening section.

9. The inkjet head of claim 6, wherein the wiring substrate is disposed between the ink manifold and the head chip, whereby ink flows through the opening section of the wire substrate from the ink manifold to the head chip.

* * * * *